US005473419A

United States Patent [19]

Russel et al.

[11] Patent Number: 5,473,419

[45] Date of Patent: Dec. 5, 1995

[54] IMAGE FORMING APPARATUS HAVING A DUPLEX PATH WITH AN INVERTER

[75] Inventors: Steven M. Russel, Pittsford; Gregory P. Mahoney, Fairport; James G. Amorese, Webster, all of N.Y.

[73] Assignee: Eastman Kodak Company, Rochester, N.Y.

[21] Appl. No.: 148,477

[22] Filed: Nov. 8, 1993

[51] Int. Cl.[6] ..... G03G 15/23

[52] U.S. Cl. ..... 355/319; 355/24

[58] Field of Search ..... 355/24, 319, 318, 355/316, 311, 208; 271/184, 185, 186

[56] References Cited

U.S. PATENT DOCUMENTS

| | | | |
|---|---|---|---|
| 4,078,789 | 3/1978 | Kittredge et al. | 271/65 |
| 4,272,181 | 6/1981 | Treseder | 271/186 X |
| 4,512,255 | 4/1985 | Crist | 101/230 |
| 4,986,529 | 1/1991 | Agarwal et al. | 271/291 |
| 5,006,900 | 4/1991 | Baughman et al. | 355/271 |
| 5,082,272 | 1/1992 | Xydias et al. | 271/186 |
| 5,165,675 | 11/1992 | Kanaya | 271/3.1 |
| 5,166,738 | 11/1992 | Tani | 355/319 |

FOREIGN PATENT DOCUMENTS

| | | |
|---|---|---|
| 0300247 | 12/1988 | Japan . |
| 0253866 | 11/1991 | Japan . |

*Primary Examiner*—Robert Beatty
*Attorney, Agent, or Firm*—Leonard W. Treash, Jr.

[57] ABSTRACT

An image forming apparatus includes a finite length recirculating duplex path without a duplex tray and having an inverter. A receiving sheet is delayed in the inverter by a time which is variable in order to vary the recirculating path time. Preferably, the time is varied according to the length of receiving sheet used so that maximum usage can be made of the image forming apparatus. A preferred inverter includes entrance and exit nips and a stop at the end of a paper chute. The stop is positioned to receive the leading edge of a sheet fed into the chute and hold the sheet through a variable time delay. The stop is then moved toward the exit nip at the end of the time delay to begin to move the receiving sheet out of the inverter. The receiving position of the stop is variable to receive sheets of different intrack length.

13 Claims, 4 Drawing Sheets

LOGIC & CONTROL
1
10
12
14
16
18
19
20
40
42
44
46
48
50
52
54
56
58
60
62
64
66
68
69
70
72
74
76
82
84
100

IMAGE FORMING APPARATUS HAVING A DUPLEX PATH WITH AN INVERTER

This invention relates to image forming apparatus having a recirculating duplex path for a receiving sheet, which duplex path includes an inverting mechanism.

Sophisticated copiers and printers are capable of producing duplex output. Images are first formed on one side of one or more receiving sheets. The receiving sheets are fed into a duplex or intermediate tray from which they are returned to the image forming apparatus for receipt of an image on their opposite side. The duplex tray serves as a buffer for stacking receiving sheets. It, thus, provides variability in the length of the return path for the receiving sheets, providing some flexibility to the apparatus in the timing in which the sheets are presented for their second image. The duplex tray also is usually positioned to automatically invert the receiving sheet for presentation of the second side of the sheet for receipt of the second, or duplex, image.

Despite the advantages, duplex trays are difficult to feed sheets out of without smearing a fresh image and are relatively expensive components. Some image forming apparatus, usually those using electronic exposure, eliminate the duplex tray and feed the receiving sheet directly back to the imaging component. These devices have a relatively invariable length return path. They eliminate many of the problems associated with duplex trays, but the timing of the presentation of the sheet for its second image is somewhat more limited because of the finite duplex path length. Further, without the duplex tray, some mechanism must be employed to invert the receiving sheet in the return path.

Modem copiers and printers accommodate a large variety of sizes of receiving sheets. Many can be set to handle ten or more sizes. Often, three or four sizes are available to an operator by pressing a button on a control panel. However, a finite length duplex return path is designed to return a particular size sheet exactly in time to receive its duplex image. A slightly larger or smaller receiving sheet will not fit the same return path an integer number of times. Obviously, flexibility can be built into this system by using a substantial size interframe to absorb the varying sizes, but this approach will reduce the efficiency of the apparatus with all but the most common sizes.

U.S. Pat. No. 5,006,900, granted to Baughman et al Apr. 9, 1991, shows a finite return path for an electronic image forming apparatus. Inversion of the receiving sheet in the duplex path is accomplished by feeding a sheet into a turn-around location and reversing a set of rollers to feed the sheet back out of the turn around with the trailing edge changing to the leading edge to invert the sheet. This apparatus uses an endless belt image member having a seam with dedicated frames and the seam in one interframe. The sizes of the interframes are varied to accommodate unusual sizes within each frame. Only letter and ledger sized sheets are handled with maximum efficiency.

U.S. Pat. No. 5,082,272, granted to Xydias et al Jan. 21, 1992, is representative of a large number of inverters using three rollers which are engaged with a middle roller driving the other two to form an input and an output nip. The receiving sheet is fed in through the input nip and out through the output nip with some mechanism being provided to assure movement of the trailing edge of the sheet from the input nip to the output nip (where it becomes the leading edge). This particular reference shows an inversion chute having a spring mechanism for receiving the leading edge of the sheet as it is driven by the input nip. The spring pushes the sheet into the output nip as the trailing edge of the sheet is urged to the output nip by the middle roller. Three roller inverters of this type are generally capable of handling a variety of sizes. They are relatively fast in that a sheet can be entering while another one is leaving with the two sheets actually contacting each other in the inverter.

U.S. Pat. No. 4,986,529 to Agarwal et al, granted Jan. 22, 1991, shows a four roller inverter using both a low rate linear compression spring and reversing rollers.

U.S. Pat. No. 5,166,738 shows a resilient stop at the end of an inversion chamber which is attached to a belt for movement by a motor to adjust the position of the stop for varying sizes.

U.S. Pat. No. 4,078,789 to Kittredge et al, granted Mar. 14, 1978, also shows a three roller inverter with a stop that is said to be adjustable for documents of different length. Other inverters have neither a stop nor reversing rollers, relying on gravity and the middle roller to move the trailing edge into the output nip.

U.S. Pat. No. 4,512,255 to Crist, granted Apr. 23, 1985, shows a duplicating machine with a bottom wall to a tray into which a sheet is fed by an input nip. The tray is cocked against a spring and released to urge the sheet into an output nip in synchronization with a first printing couple which, apparently, includes an impression cylinder. An air jet forces the trailing edge of the sheet into the output path from the input nip. This structure is apparently designed for use with tandemly arranged printing couples for duplexing images.

SUMMARY OF THE INVENTION

It is an object of the invention to provide an image forming apparatus having a recirculating duplex path with an inverter but which is able to handle a variety of receiving sheets and/or images efficiently.

This and other objects are accomplished by an image forming apparatus having first means for moving a receiving sheet along a feed path from a first position to a second position. An image forming means is positioned adjacent the feed path for forming a first image on a first side of a receiving sheet moving through the feed path. A second means for moving the receiving sheet is positioned to move the receiving sheet through a recirculating path from the second position back to the first position where the receiving sheet can, again, be moved through the feed path to receive a second image. Means for inverting a receiving sheet after it receives the first image and before it receives the second image is associated with the paths. The image forming apparatus includes a logic and control which controls image formation and varies the time the sheet is in the inverter to vary the total recirculation time and optimize arrival of the sheet back at the image forming means.

According to a preferred embodiment, the inverting means includes entrance means for feeding a receiving sheet into a turn around chute, exit means adjacent the entrance means for feeding a receiving sheet out of the chute and edge engaging means for engaging a leading edge of a receiving sheet in the chute after it leaves the entrance means. Actuatable means is associated with the edge engaging means for moving the edge engaging means to push the sheet into the exit means. The logic and control determines actuation of the means for moving the edge engaging means to provide a predetermined delay in recirculation of the receiving sheet.

According to a further preferred embodiment, the predetermined delay in the inverter is variable according to the intrack dimension (sometimes herein called the "length") of the receiving sheet. The delay in the inverter can be varied to assure that any of a variety of sizes of sheets arrives back at the image forming means at the proper time to receive its second image while efficiently using the image forming means.

According to a further preferred embodiment, image formation is also varied, i.e., the size of the interframe is varied slightly between image sizes. In its broadest application, this provides an additional degree of design freedom in accommodating many sizes, e.g., on a continuous (unseamed) image member. In a more specific application, variation of the interframe fits the images on a finite seamed image member.

According to a further preferred embodiment of the invention, the means for engaging the leading edge of the receiving sheet is variable in position in order to accommodate sheets of varying length. Preferably, the means for varying the position for accommodating different length receiving sheets also moves the receiving sheet into the output nip or device.

It is also an aspect of the invention to provide a sheet inverter, per se, that receives a sheet from a path and feeds it back into the path in an inverted orientation but which holds the sheet for a variable time.

DESCRIPTION OF THE PREFERRED EMBODIMENTS

Figure 1:
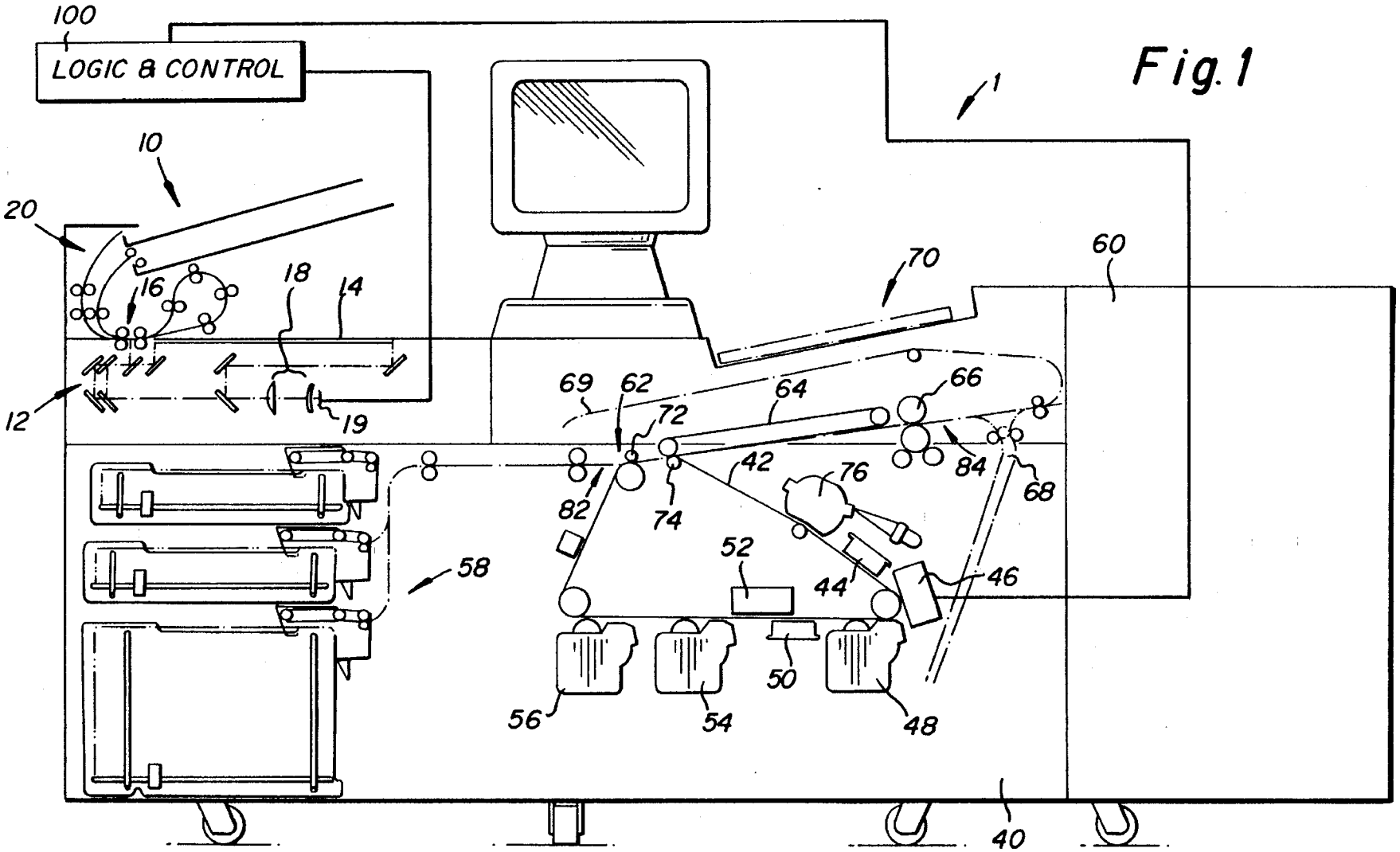
FIG. 1 is a side schematic of an image forming apparatus.

Referring to FIG. 1, an image forming apparatus 1 is shown as a copier, but can be a printer or both. As a copier, it includes a marking engine 40, accessory module 60, paper supply 58 and a document scanner 10. In operation, the document scanner 10 includes a document feeder 20 which presents a series of document sheets to an exposure position 16. As the sheets pass the exposure position 16, they are scanned through a set of mirrors 12 and optics 18 onto a linear CCD 19 for conversion of the optical information into an electronic signal. A stationary document that is difficult to feed can also be placed on an exposure platen 14 and the mirrors moved to effect the same scanning approach. The electronic signal created from CCD 19 is fed into suitable electronics located in a logic and control 100. The suitable electronics stores the electronic signal representing the image information for printing by the marking engine 40.

The marking engine 40 can use any suitable image forming technology, for example, inkjet or thermal. However, it is shown in FIG. 1 as including an electrophotographic image forming means. The image forming means includes an image member, for example, a seamed photoconductive belt 42 which is trained around a series of rollers for movement past a series of stations well known in the electrophotographic art. More specifically, belt 42 passes a charging station 44 where a uniform charge is placed on the surface. The charged surface is imagewise exposed at an electronic exposure station, for example, an LED printhead 46 which is controlled by logic and control 100 using information obtained from document scanner 10. This exposure creates an electrostatic image corresponding to the image detected by CCD 19. The electrostatic image is developed at a developing or toning station 48 by the application of fine, dry toner to create a toner image corresponding to the electrostatic image. In a printer mode, printhead 46 can also receive image information from a computer, an image storage media or the like, not shown.

This process can be repeated with a second color to form a two color image. To accomplish this, the surface of the belt is, again, uniformly charged by a second charger 50. It is imagewise exposed, preferably through the rear, using a second LED printhead 52 to create a second electrostatic image in the same general area containing the first toner image. The second electrostatic image is developed by one of developing or toning stations 54 and 56, which toning stations preferably contain different color toners, giving the operator a choice of the second color portion of the image. This two color process can be employed using three colors with a somewhat larger marking engine. It is a process that is known in the art and generally is used with discharged area development and electronic exposure.

The one or two color image is moved on to a transfer station 62. At the same time, a receiving sheet is fed out of paper supply 58 and into a paper path that brings it past the image forming means. The receiving sheet moves into overlying relation with the toner image at the transfer station 62. Transfer of the toner image to the receiving sheet is accomplished by an electrostatic field which can be created by biasing a transfer backing roller 72 or by a transfer corona, both of which are well known in the art. The receiving sheet is separated from belt 42 as belt 42 goes around a small roller 74. The belt is cleaned at a cleaning station 76 for continuous use.

The receiving sheet is transported by a suitable sheet transport device 64 to a fuser 66. The toner image is fused to the receiving sheet by fuser 66 and exits the fuser. Thus far, the receiving sheet has moved along a feed path from a first position 82 entering the transfer station to a second position 84 exiting the fuser at a relatively constant speed determined by the speed of the image member 42. After it exits the fuser, the receiving sheet can be handled according to several options. It can be fed into accessory module 60 where it can be stapled, stacked, bound or otherwise further finished. It can be transported to an upper output hopper 70 where it is stacked in a single stack for the operator. It can also be returned to transfer station 62 through a recirculating path to receive another image on either side. One reason for transferring another image to the same side of the receiver as the first image would be to add another color to that image. In most instances, return to the transfer station is to add an image to the opposite side of the receiving sheet from that containing the first image to form a duplex copy. The sheets in output hopper 70 can be stacked either faceup or facedown, depending on the order in which the images are formed.

Obviously, some of these options in handling the receiving sheet involve inverting the receiving sheet a different number of times than others of the options. The entire path just described from transfer station 62 through fuser 66 and back around to transfer station 62 is shown in FIG. 1 as a continuous oblong duplex path or loop 69. This path does not include an intermediate tray and, therefore, does not naturally provide an ultimate inversion of the copy sheet for doing duplex. That is, if the sheet is continuously fed through path 69 without alteration, it will continually present the same side of the sheet to image member 42 at transfer station 62. Thus, to do duplex, an inverter 68 is required. As is known in the art, inverter 68 is conveniently positioned between the fuser 66 and accessory module 60.

This allows the use of the inverter to change the orientation of the receiving sheet as part of virtually all options available to the receiving sheet. That is, the receiving sheet can be inverted or not before entering the accessory module, before entering the upper output hopper 70 or before being recirculated back to transfer station 62 to receive an additional image.

Recirculating duplex paths such as that shown at 69 in FIG. 1 are well known in the art. They do not include an intermediate tray, whose absence eliminates a source of problems known to intermediate trays. However, because they are generally of a relatively invariable finite length, they create their own set of design challenges. The receiving sheet that receives an image on the first side and is recirculated back to receive an image on the second side must arrive at the transfer station 62 at a relatively exact time to properly position the second image on the sheet. This requires synchronization, for example, between the movement of the receiving sheet through path 69 and the placement of the image on image member 42 by LED printhead 46.

This timing is exacerbated by the desire of modem copiers and printers to handle a large variety of sizes of sheet. If path 69 is of finite length, it is highly desirable, if not essential, that the length of the duplex path 69 divided by the pitch of the receiving sheets be an integer. One way this is accomplished in the prior art is to have substantial size dedicated frames and allow the interframe to absorb the differences in intrack dimension (herein sometimes called "length") of the receiving sheets. A typical frame pitch could be 18 inches (457 mm), which would accommodate efficiently the long dimension of a ledger sized sheet or the short dimension of two letter sized sheets for each frame. All other sizes would be done less efficiently, depending upon how close in size their intrack dimension is to the ledger or letter sized sheets.

If the image member is a seamed belt, the length of the belt is also chosen to be an integer number of frames. If the image member is continuous, as are most photoconductive drums, this requirement is eliminated.

Applicants have solved this problem of inefficiency by varying the effective length of the return path 69. This varying of the effective length of return path 69 can be accomplished in several manners. For example, the speed of movement of the receiving sheet in the portion of the paths after the sheet has exited the fuser, can be varied. The actual measured length of the path after exit from the fuser can be varied with adjustable guides and drives. However, according to applicants' preferred embodiment, as illustrated in the FIGS., the effective length of the duplex path 69 is varied by varying the length of time that a receiving sheet is held in the inverter 68. Preferably, although clearly not required, this feature is coupled with moving the receiving sheet at a faster speed during a portion of the return path remote from the fuser and transfer stations than the receiving sheet moves between the transfer station and the fuser. Thus, preferably, the entire duplex path 69 has two speeds, each of them relatively constant except for ramping up and down between them. The first speed is controlled by the speed of belt 42. Transport 64 necessarily moves at the same speed as belt 42. This substantially dictates the speed of fuser 66 and, thus, the speed from the time the receiving sheet enters the transfer station 62 to the time it leaves fuser 66 is substantially the same as that of belt 42. At some point after the receiving sheet leaves fuser 66 until some point before it, again, enters transfer station 62, the receiving sheet is fed at a speed that is faster than that of belt 42.

The inverter 68 and its operation is shown in FIGS. 2–6. The orientation in FIGS. 2–6 is somewhat different than that shown in FIG. 1. However, although gravity can be used to control the paper and some of its movement, the operation of the inverter is not particularly dependent upon orientation. Thus, the orientation with respect to gravity shown in FIGS. 2–6 (or in FIG. 1 ) is illustrative only.

Figure 2:
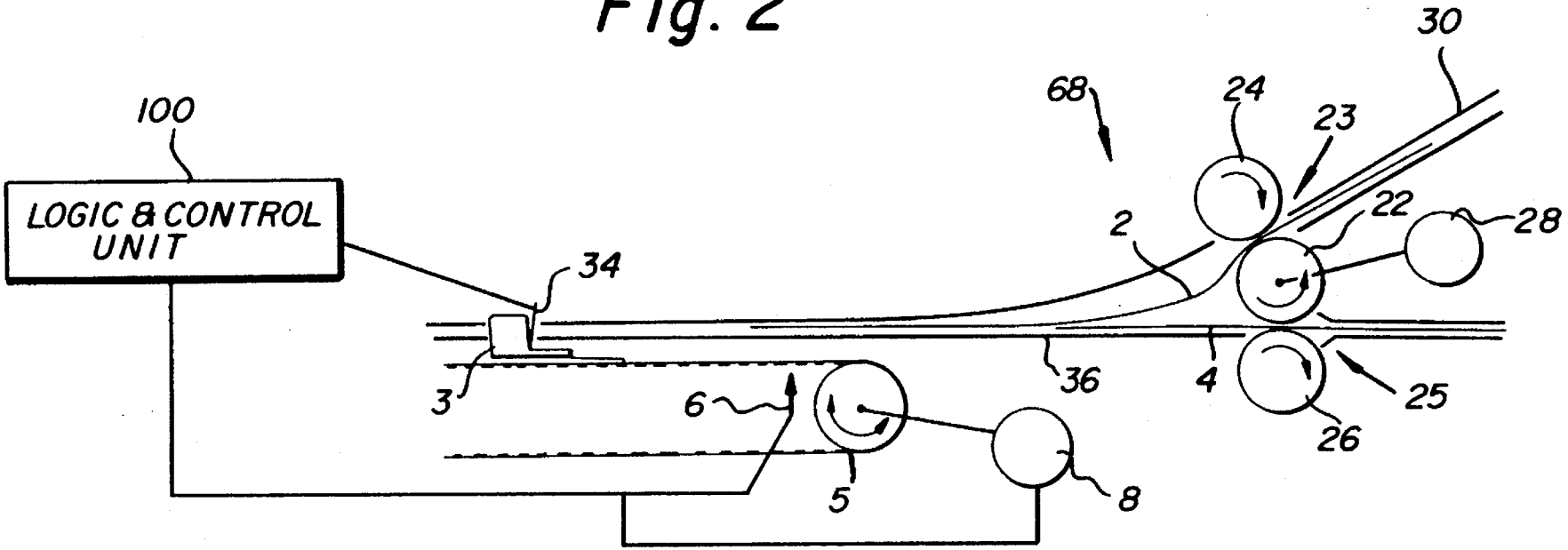
FIGS. 2–6 are side schematics of an inverting mechanism forming a portion of the image forming apparatus.

Referring to FIG. 2, inverter 68 includes a set of three rollers, a middle or drive roller 22, an entrance roller 24 and an exit roller 26. Entrance roller 24 engages drive roller 22 to form an entrance nip 23 and exit roller 26 also engages drive roller 22 to form an exit nip 25. Drive roller 22 is driven by a roller drive motor 28. Such three roller arrangements are well known in the art.

An entering sheet 2 approaches entrance nip 23 in an appropriate guide, for example, an entrance chute 30. Rollers 23 and 24 move entering sheet 2 through entrance nip 23 into a paper chute 36. Paper chute 36 is terminated by a stop, for example, an adjustable, preferably non-resilient stop gate or gates 3 which is coupled to an arrival sensor 34 and is positioned by a traverse mechanism 5. Traverse mechanism 5 is an endless belt controlled by a traverse drive motor 8 which is preferably a stepper motor.

Figure 3:
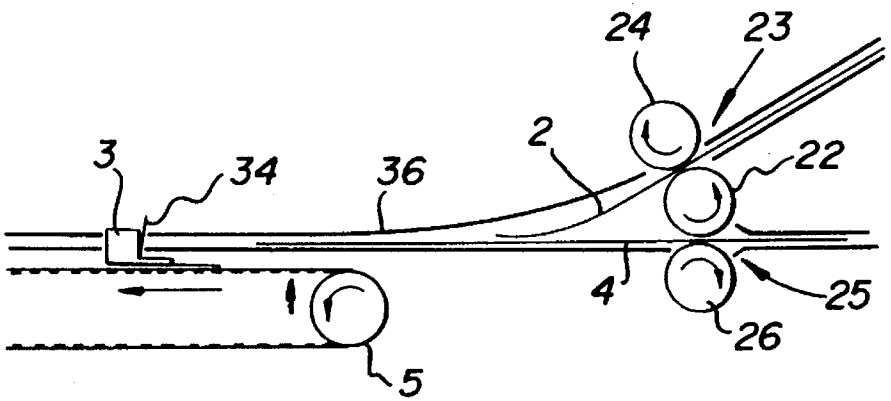
Figure 4:
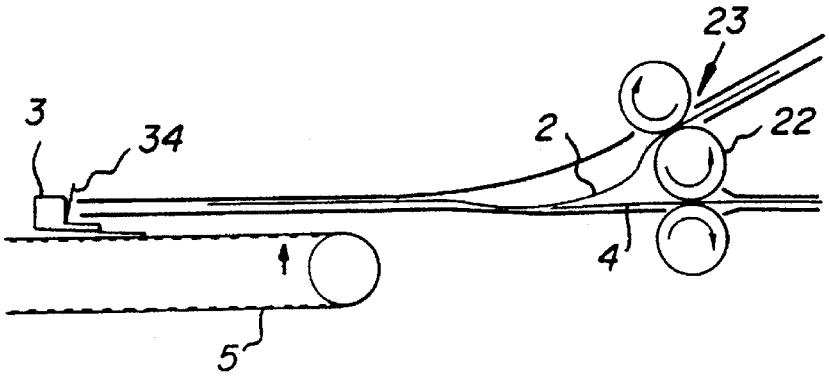
Figure 5:
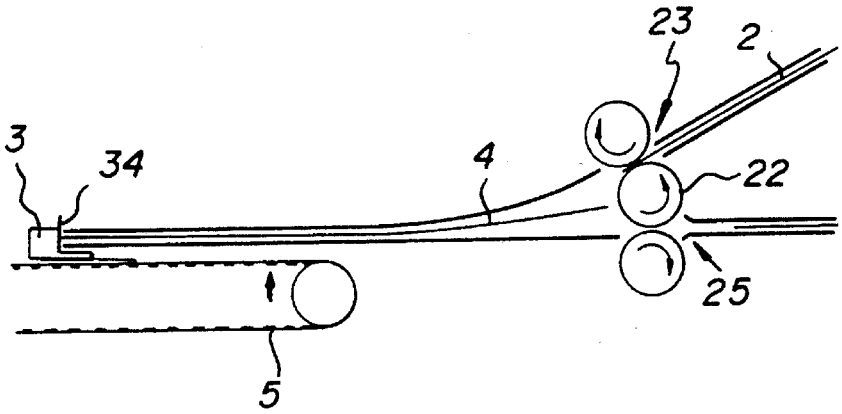

As shown in FIG. 3, entering sheet 2 enters chute 36 through entrance nip 23 while an exiting sheet 4 is being driven out of chute 36 by rollers 22 and 26 through exit nip 25. At the same time, traverse mechanism 5 is being moved by motor 8 to position stop gates 3 appropriately for the arrival of incoming entering sheet 2. According to FIG. 4, stop gate 3 has reached its desired position which is slightly beyond the buckle point of the sheet with respect to entrance nip 23 and drive roller 22. As seen in FIG. 5, the leading edge of sheet 2 has reached stop gate 3 and actuated arrival sensor 34. Note that the trailing end of sheet 2 is free of roller 22. In the orientation shown in these FIGS., gravity properly positions the trailing end of sheet 2 so that it may enter exit nip 25. Chute 36 also has a bit of a curve to it which, even without the help of gravity, would tend to move the sheet to its appropriate position for entering exit nip 25, utilizing the beam strength of the sheet.

Figure 6:
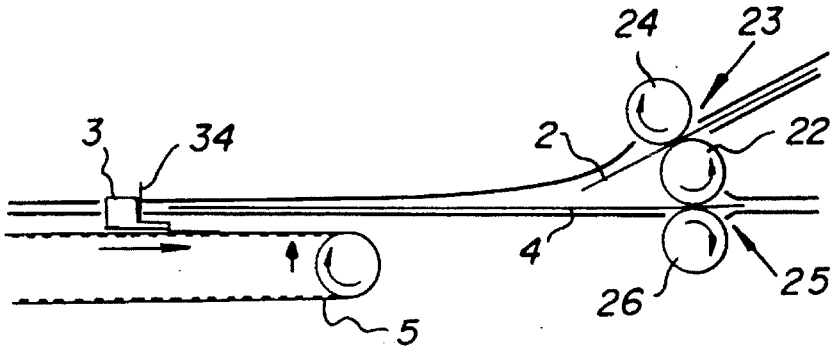

Referring to FIG. 5, the sheet has not yet become an exiting sheet and is resting against stop gate 3 with the traverse mechanism stationary. It is held in this position until a signal from logic and control 100 causes motor 8 to actuate traverse mechanism 5 to move stop gate 3 from the left to the right as shown in the FIGS. This movement of stop gate 3 pushes on what had been the leading edge of the entering sheet and is now the trailing edge of the exiting sheet to push the sheet into exit nip 25. This action is shown in FIG. 6 with the exiting sheet 4 now being fed by the rollers 22 and 26 through exit nip 25 while a new entering sheet 2 is being fed into chute 36 through entrance nip 23.

Because the trailing edge of the entering sheet is intended to be fed past engagement with drive roller 22, the action of drive roller 22 will have less effect on the trailing edge of the sheet in positioning it for the exit nip than in the traditional buckling type three roller inverter. Accordingly, gravity, a curved chute, a flexible finger or even a positive urging by an air puff or the like can be used to assist in that positioning. (See discussion of FIG. 7 below.)

A home sensor 6 informs logic and control 100 of the location of stop gate 3 so that logic and control 100 can better control traverse mechanism 5. Note that logic and control 100 has the responsibility for actuating stepper motor 8 to both drive the sheet toward the exit nip at the appropriate time and to move the stop gate to the appropriate position with respect to the paper chute 36 for the particular length of paper entering the entrance nip. Thus, stop gate 3 is driven by stepper motor 8 both to its position for proper receipt of a sheet of a particular length and to move the sheet into the exit nip. It also must return stop gate 3 to its sheet receiving position. These three motions of stop gate 3 are all controlled by logic and control 100 using motor 8. Logic and control receives an input of the intrack receiver sheet length from an operator control panel or a length sensor, both of which are conventional.

Note that in the FIGS. there are two sheets in the inverter at once. This is possible as long as the gate actuates and returns before the incoming sheet gets too close. There is a practical limit to the amount of overlap tolerable by the system. This limit is about 75 percent of the sheet cycle time which, for 8.5 inch length paper, amounts to about 0.375 seconds with the sheets moving into the entrance nip at 20 inches per second.

Figure 7:
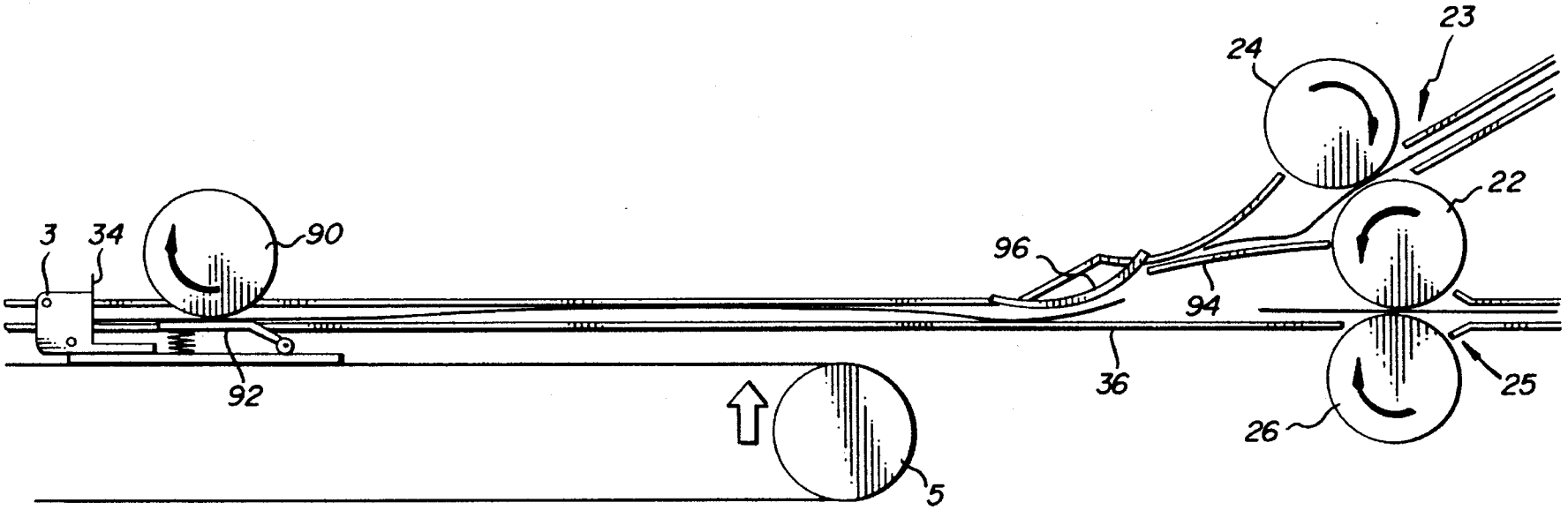
FIG. 7 is a side schematic of an alternative inverting mechanism.

FIG. 7 shows an embodiment of the inverter essentially the same as that shown in FIGS. 2–6 except that several paper controlling features have been added.

A first resilient deflector strip 94 engages the leading end of the entering sheet to urge it against the top wall of chute 36 to prevent it from interfering with an exiting sheet. When no sheet is urging the free (left) end of strip 94 downward, it can recess into the top wall to not interfere with an exiting leading edge.

A second deflector strip 96 is positioned slightly downstream the first strip 94. It pushes the leading portion of the exiting sheet downward to assure entrance of the leading edge into exit nip 25.

The trailing edge of an entering sheet leaves entrance nip 23 before the leading edge reaches gate 3. In some configurations, gravity or inertia may complete its engagement with gate 3. FIG. 7 shows a preferred approach to this problem. An urging roller 90 is constantly driven to lightly urge the sheet toward gate 3. It is backed by a lightly biased plate 92, forming an urging roller nip, known per se, in sheet handling. It moves the paper strongly enough to push it into gate 3. A spring on plate 92 is soft enough to allow skew correction against gate 3 and the feeding of the sheet into the exit nip by movement of gate 3. It could be movable with gate 3, but for reliability and cost reasons, is preferably fixed close to the upstream most position of gate 3.

Although the inverters shown in FIGS. 2–7 are believed to be unique, per se, and have application to paper handling even without a variable delay, they have particular use in the apparatus shown in FIG. 1.

An illustrative embodiment in which the logic and control varies the effective length of the recirculating path to make efficient use of an image forming apparatus in a duplex mode will be helpful in understanding the invention. In the example, it is assumed that as many images as possible of each size are placed on a seamed photoconductor having a length of 62.832 inches (1570 mm). Because the photoconductor (image member) is a seamed belt, the interframe will vary slightly according to the receiving sheet size. It is assumed that the image member speed is 20.944 inches (524 mm) per second and that all of the receiving sheets will be the same size, although that size will vary from batch to batch. Because the image member speed is 20.944 inches (524 mm) per second, that is also the speed that the receiving sheet is moved from the first position 82 entering the transfer station to the second position 84 exiting the fusing station. Assuming that the inverter is positioned as shown (close to the fuser), both the entrance and exit nip of the inverter will also be driven to move a sheet at that speed. (A four roller inverter could be used to provide a faster exit speed than entrance speed.)

With the three roller inverter shown, once the receiving sheet has left the exit nip of the inverter, it can, at any point in the recirculation path, be sped up. For purposes of this example, it is assumed that it is sped up to a speed of 30 inches (750 mm) per second until it approaches the transfer station again, at which point it would be reduced in speed to the 20.944 inches (524 mm) per second of the image member.

The possible lengths of duplex paths and sheet speeds are infinite. For this example, a duplex path of about 80 inches (2000 mm) was chosen. Because the stop gate 3 is moved for varying length sheets, the physical intrack length of the total duplex path varies.

Six images having lengths of 7.17, 8, 8.27, 8.5, 8.86 and 9 inches (182, 203, 210, 216, 225 and 228 mm) are made in one length of the belt. The receiving sheets are delayed in the inverter 0.17, 0.09, is 0.06, 0.04, 0.00 and 0.00 seconds, respectively, for them. For these lengths, nine images fit the duplex path substantially evenly with small interframes that vary to fit the photoconductive belt.

For sheets having lengths 10, 10.12, 11 and 11.69 inches (254, 257, 280 and 297 mm) in length, five images are made on a single length of the belt and eight receiving sheets are fit into the duplex path using delays in the inverter of 0.25, 0.24, 0.20 and 0.17 seconds, respectively. Sheets 14 inches (356 mm) in length and 14.33 inches (364 mm) in length would be delayed 0.51 and 0.49 seconds, respectively, in a seven sheet duplex path with four images per belt length. Sheets 16.54, 17 and 18 inches (420, 432 and 457 mm) in length would be delayed by 0.14, 0.11 and 0.07 seconds, respectively, in a five sheet recirculating path with three images on each belt length. Thus, with the delays in the inverter, 15 different intrack lengths of sheet can be fed as though each of them were an integer divisor of the entire duplex path. Extremely efficient use of the image forming means is provided, giving high speed output for all sizes, not just letter and ledger size sheets. Note that the interframes would not need to be varied with a continuous image member, for example, a continuous drum, and slightly greater efficiency could be obtained. Alternatively, some variation of interframe could still be used to reduce maximum delays in the inverter.

A similar result can be accomplished by varying the speed of movement of the receiving sheet in the unconstrained portion of the recirculating path and using a constant delay in the inverter. This approach is inferior to that just described with the variable delay in the inverter because the recirculating path transport becomes much more complicated and more difficult to control. The same result could also be obtained by varying the actual physical length of the path. Again, this would require movement of guides or rollers and, again, would increase the expense of the recirculating path while reducing its reliability. Note, again, that, in the example, the positioning of stop gate 3 does vary the physical length of the duplex path. This is accounted for in the inverter delay times.

The inverter as shown in FIGS. 2–7 is particularly adapted for providing a variable delay useful in the image forming apparatus of FIG. 1. However, other inverters could be used. For example, a known inverter in which the sheet is held by a pair of rollers that drive the sheet into an inverting region and then reverse and drive it out of the inverting position could also be used. In this instance, the rollers would be stopped for the appropriate delay time before the sheet is driven out of the inverting position. (In a more expensive alternative, the reversing rollers could be driven at a variable speed.)

Speeding up the recirculation portion of the duplex path provides a shorter access time for the first sheet. The invention can be used without this feature with the entire duplex path run at a constant speed.

This particular inverter shown in FIGS. 2–7 has other more specific advantages. For example, it is relatively insensitive to sheet thickness or stiffness. Each sheet is corrected as to skew before leaving the inverter because it is preferably totally free of the input nip and the drive roller 22. The inverter is relatively gentle with edges compared to inverters that rely on a buckling of the sheet to move the trailing edge to the exit nip. It is able to accommodate two sheets in the chute simultaneously for at least some portion of the cycle time. No acceleration through the mechanism is required.

The invention has been described in detail with particular reference to a preferred embodiment thereof, but it will be understood that variations and modifications can be effected within the spirit and scope of the invention as described hereinabove and as defined in the appended claims.

We claim:

1. Image forming apparatus comprising:

an image member, means for forming a series of toner images on the image member, means for holding a supply of receiving sheets, each sheet having first and second sides and first and second opposite edges, a transfer station including means for transferring a toner image from the image member to a side of a receiving sheet, means for feeding receiving sheets from the means for holding to the transfer station with the first side of the receiving sheet oriented to receive a toner image, means for feeding one or more receiving sheets through a finite length duplex path back to the transfer station to receive another toner image, means for inverting a sheet in the duplex path to change the side of the sheet being presented to the toner image at the transfer station, said inverting means including non-resilient means for engaging a leading edge of a receiving sheet to stop movement of the receiving sheet into the inverter, said engaging means being movable to push the receiving sheet to start movement of the receiving sheet out of the inverter, a motor coupled to said engaging means for moving said engaging means to start movement of the receiving sheet out of the inverter, and logic and control coupled to said motor for controlling movement of the engaging means to start movement of the receiving sheet out of the inverter, said logic and control including means for varying the time between engagement of the leading edge of the receiving sheet with the engaging means and such movement of the engaging means.

2. Image forming apparatus according to claim 1 further including means for inputting the intrack length of each receiving sheet into the logic and control and means for controlling said time according to the length of said receiving sheet.

3. Image forming apparatus according to claim 1 wherein the inverter includes three engaged rollers forming entrance and exit nips and a chute for receiving a sheet from the entrance nip, the engaging means being positioned to terminate the length of the chute available to the sheet.

4. Image forming apparatus according to claim 1 wherein said logic and control includes means for controlling the motor to move the engaging means to position it to receive different lengths of sheet.

5. Image forming apparatus according to claim 1 wherein said motor is a stepper motor controlled by said logic and control.

6. Image forming apparatus according to claim 1 wherein said means for engaging includes means for sensing the arrival of the leading edge of a sheet and of inputting such arrival to the logic and control.

7. Image forming apparatus comprising:

first means for moving a receiving sheet along a feed path from a first position to a second position, image forming means adjacent the feed path for forming a first image on a first side of a receiving sheet moving along the feed path, second means for moving a receiving sheet through a recirculating path from the second position back to the first position where the receiving sheet can again be moved through the feed path to receive a second image from the image forming means, means for inverting a receiving sheet after it receives the first image and before it receives the second image, said inverting means including, input means for feeding a receiving sheet into a chute, output means adjacent the input means for feeding a receiving sheet out of the chute, non-resilient edge engaging means for engaging a leading edge of the receiving sheet in the chute after it leaves the input means, a stepper motor for moving the edge engaging means to push the sheet into operative engagement with the output means, and means for delaying the time between engagement of the leading edge of the receiving sheet by the edge engaging means and actuation of the motor.

8. Image forming apparatus according to claim 7 further including means for positioning the edge engaging means with respect to the chute at a plurality of positions for use with receiving sheets of varying intrack lengths.

9. Image forming apparatus according to claim 7 wherein the means for delaying includes logic and control means for controlling the delay to return sheets of different length to the image forming means in a predetermined timing with respect to the image forming means.

10. Image forming apparatus according to claim 9 wherein the image forming means includes an endless belt, means for forming a series of toner images on said endless belt and means for transferring toner images from the belt to a receiving sheet moving along the feed path.

11. Image forming apparatus according to claim 10 wherein the endless belt includes a seam.

12. Image forming apparatus according to claim 10 wherein said means for forming toner images includes means for positioning the maximum number of images on the endless belt without overlapping the seam for a plurality of different intrack image lengths.

13. Image forming apparatus according to claim 12 wherein the means for delaying controls arrival of the receiving sheets at the forming means coincident with the arrival of a toner image to be transferred to the receiving sheets.

* * * * *